US006647095B2

(12) United States Patent
Hsieh

(10) Patent No.: US 6,647,095 B2
(45) Date of Patent: Nov. 11, 2003

(54) METHOD AND APPARATUS FOR OPTIMIZING DOSAGE TO SCAN SUBJECT

(75) Inventor: Jiang Hsieh, Brookfield, WI (US)

(73) Assignee: GE Medical Systems Global Technology Co., LLC, Waukesha, WI (US)

( * ) Notice: Subject to any disclaimer, the term of this patent is extended or adjusted under 35 U.S.C. 154(b) by 0 days.

(21) Appl. No.: 10/063,233

(22) Filed: Apr. 2, 2002

(65) Prior Publication Data

US 2003/0185345 A1 Oct. 2, 2003

(51) Int. Cl.[7] ..... G21K 3/00
(52) U.S. Cl. ..... 378/159; 378/156
(58) Field of Search ..... 378/4, 18, 51, 378/56, 156, 157, 158, 159, 207

(56) References Cited

U.S. PATENT DOCUMENTS 3,717,768 A * 2/1973 Edholm et al. ..... 378/156
4,288,695 A * 9/1981 Walters et al. ..... 378/5
4,497,062 A * 1/1985 Mistretta et al. ..... 378/158
5,225,980 A * 7/1993 Hsieh et al. ..... 378/18
5,301,108 A * 4/1994 Hsieh ..... 378/8
5,473,656 A * 12/1995 Hsieh et al. ..... 378/4
5,473,663 A * 12/1995 Hsieh ..... 378/207
5,706,326 A * 1/1998 Gard ..... 378/19
5,881,127 A * 3/1999 Molloi et al. ..... 378/159
5,901,198 A * 5/1999 Crawford et al. ..... 378/57
6,280,084 B1 * 8/2001 Toth ..... 378/207
6,307,918 B1 * 10/2001 Toth et al. ..... 378/158
6,501,828 B1 * 12/2002 Popescu ..... 378/150

OTHER PUBLICATIONS

Hsieh, J., Toth, T., Simoni, P., Grekowicz, B., Slack, C., Seidenschnur, G., A Generalized Helical Reconstruction Algorithm for Multi–slice CT, Scientific Program, The Radiology Society of North America, 87$^{th}$ Scientific Assembly and Annual Meeting, Nov. 25–30, 2001.

* cited by examiner

*Primary Examiner*—Edward J. Glick
*Assistant Examiner*—Allen C Ho
(74) *Attorney, Agent, or Firm*—Ziolkowski Patent Solutions Group, LLC; Michael A. Della Penna; Carl B. Horton

(57) ABSTRACT

The present invention is directed to a CT imaging system utilizing a pre-subject cone-angle dependent filter to optimize dosage applied to the scan subject for data acquisition. The cone angle dependent pre-subject filter is designed to have a shape that is thicker for outer detector rows and thinner for inner detector rows. As a result, x-rays corresponding to the outer detector rows undergo greater filtering than the x-rays corresponding to the inner detector rows.

23 Claims, 6 Drawing Sheets

METHOD AND APPARATUS FOR OPTIMIZING DOSAGE TO SCAN SUBJECT

BACKGROUND OF THE INVENTION

The present invention relates generally to computed tomography (CT) technology, and more particularly, to a method and apparatus for optimizing the dosage applied to a scan subject to acquire imaging data. Specifically, the present invention is directed to a cone angle dependent pre-subject filter.

Typically, in CT imaging systems, an x-ray source emits a fan-shaped beam toward a scan subject, such as a patient. The beam, after being attenuated by the subject, impinges upon an array of radiation detectors. The intensity of the attenuated beam radiation received at the detector array is typically dependent upon the attenuation of the x-ray beam by the subject. Each detector element of the detector array then produces a separate electrical signal indicative of the attenuated beam received by that detector element. The electrical signals are then transmitted to a data processing unit for analysis and ultimately image reconstruction.

Generally, the x-ray source and the detector array are rotated with a gantry within an imaging plane and around the scan subject. X-ray sources typically include x-ray tubes, which emit the x-ray beam at a focal point. X-ray detectors typically include a collimator for collimating x-ray beams received at the detector, a scintillator for converting x-rays to light energy adjacent the collimator, and photodiodes for detecting the light energy from an adjacent scintillator.

There has been a general desire toward reducing radiation exposure in such systems. Reduction of radiation dosage to scan subjects is therefore desirable on CT systems. A number of imaging techniques have been developed to reduce the radiation dose directed toward a scan subject for data acquisition. However, these imaging techniques often result in higher signal-to-noise ratios and poor image quality.

It would therefore be desirable to design an imaging system that optimizes the dose of radiation projected to the scan subject for data acquisition without jeopardizing image quality.

BRIEF DESCRIPTION OF INVENTION

The present invention is directed to a CT imaging system utilizing a cone angle dependent pre-subject filter to optimize dosage applied to the scan subject for data acquisition. The cone angle dependent pre-subject filter is designed to have a variable shape. In one embodiment the shape is thicker for outer detector rows and thinner for inner detector rows. As a result, x-rays corresponding to the outer detector rows undergo greater filtering than the x-rays corresponding to the inner detector rows which also evens noise distribution. All of which overcome the aforementioned drawbacks.

Therefore, in accordance with one aspect of the present invention, a cone angle dependent pre-subject filter for use with a radiation emitting imaging device is provided. The filter includes a flat surface as well as a concave surface. A number of sidewalls connecting the flat surface and the concave surface in a single solid structure are also provided.

In accordance with another aspect of the present invention, a radiation emitting imaging device includes a rotatable gantry having an opening defined therein for receiving a subject to be scanned. The device further includes a subject positioner configured to position the subject within the opening as well as a high frequency electromagnetic energy projection source configured to project high frequency electromagnetic energy to the subject. The imaging device further includes at least one filtering device configured to filter high frequency electromagnetic energy projected to the subject. The filtering device is formed of a bulk of filtering material having a non-uniform attenuation. The imaging device also includes a detector array having a plurality of detectors to detect high frequency electromagnetic energy passing through the subject and to output a plurality of electrical signals indicative of an intensity of the high electromagnetic energy detected: A data acquisition system is provided and connected to the detector array and configured to receive a plurality of electrical signals. An image reconstructor connected to the data acquisition system is provided and configured to reconstruct an image of the subject from the plurality of signals received by the data acquisition system.

In accordance with a further aspect of the present invention, a cone angle dependent pre-subject filter includes means for receiving high frequency electromagnetic energy. The filter further includes means for increasing attenuation of high frequency electromagnetic energy flux in a first region as well as means for decreasing attenuation of high frequency electromagnetic energy flux in a second region.

In accordance with yet another aspect of the present invention, a method of manufacturing a pre-subject filter for use with a radiation emitting imaging device includes the step of defining a block of filtering material. The method further includes shaping the block to have a linear surface and fashioning the block to have a curvilinear surface.

Various other features, objects and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION

The operating environment of the present invention is described with respect of a four-slice computed tomography (CT) system. However, it will be appreciated by those of ordinary skill in the art that the present invention is equally applicable for use with other multi-slice configurations. Moreover, the present invention will be described with respect to the detection and conversion of x-rays. However, one of ordinary skill in the art will further appreciate, that the present invention is equally applicable for the detection, conversion, and convergence of other high frequency electromagnetic energy. Additionally, the present invention will be described with respect to a "third generation" CT scanner, but is applicable with other generation CT scanners as well.

Figure 1:
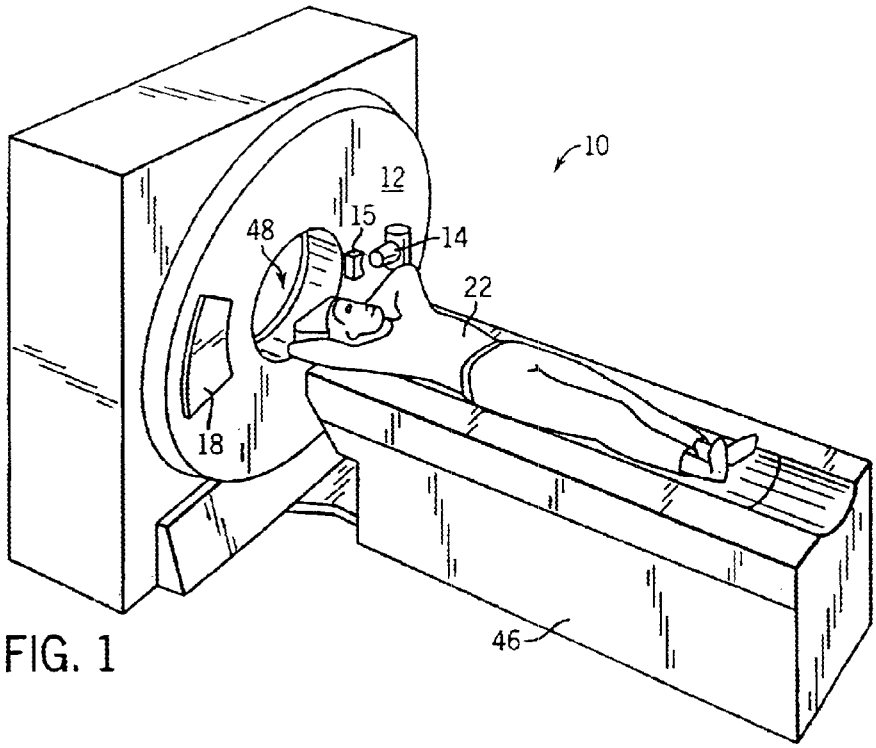
FIG. 1 is a pictorial view of a CT imaging system.
Figure 2:
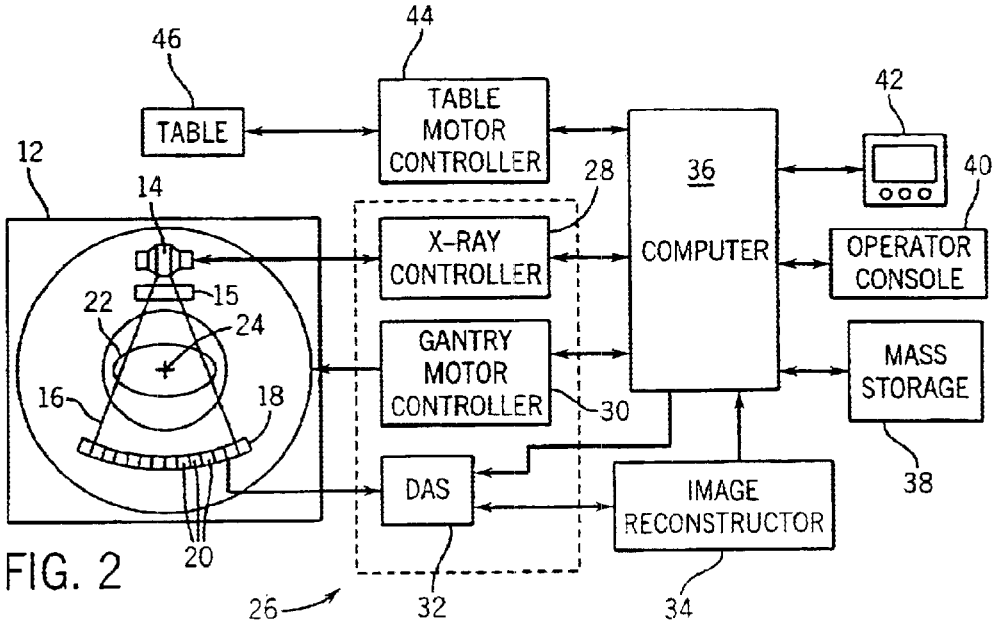
FIG. 2 is a block schematic diagram of the system illustrated in FIG. 1.

Referring to FIGS. 1 and 2, a computed tomography (CT) imaging system 10 is shown as including a gantry 12 representative of a "third generation" CT scanner. Gantry 12 has an x-ray source 14 that projects a beam of x-rays 16 toward a detector array 18 on the opposite side of the gantry 12. A pre-subject filter 15 is disposed between source 14 and patient 22 to filter the x-rays received by patient 22. Detector array 18 is formed by a plurality of detectors 20 which together sense the projected x-rays that pass through the medical patient 22. Each detector 20 produces an electrical signal that represents the intensity of an impinging x-ray beam and hence the attenuated beam as it passes through the patient 22. During a scan to acquire x-ray projection data, gantry 12 and the components mounted thereon rotate about a center of rotation 24.

Rotation of gantry 12 and the operation of x-ray source 14 are governed by a control mechanism 26 of CT system 10. Control mechanism 26 includes an x-ray controller 28 that provides power and timing signals to an x-ray source 14 and a gantry motor controller 30 that controls the rotational speed and position of gantry 12. A data acquisition system (DAS) 32 in control mechanism 26 samples analog data from detectors 20 and converts the data to digital signals for subsequent processing. An image reconstructor 34 receives sampled and digitized x-ray data from DAS 32 and performs high speed reconstruction. The reconstructed image is applied as an input to a computer 36 which stores the image in a mass storage device 38.

Computer 36 also receives commands and scanning parameters from an operator via console 40 that has a keyboard or other data entry device. An associated cathode ray tube display 42 allows the operator to observe the reconstructed image and other data from computer 36. The operator supplied commands and parameters are used by computer 36 to provide control signals and information to DAS 32, x-ray controller 28 and gantry motor controller 30. In addition, computer 3,6 operates a table motor controller 44 which controls a motorized table 46 to position patient 22 and gantry 12. Particularly, table 46 moves portions of patient 22 through a gantry opening 48.

Figure 4:
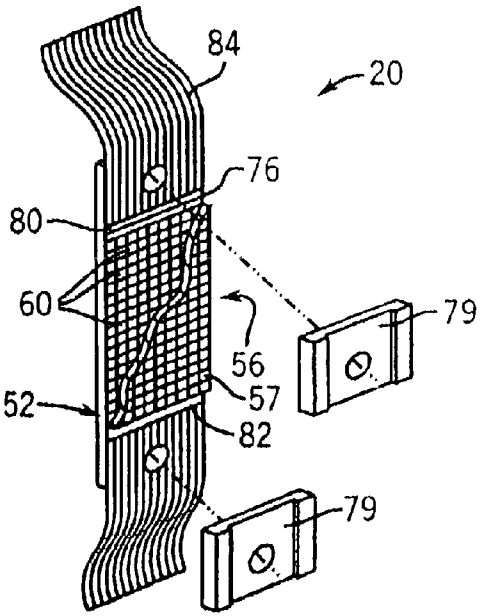
FIG. 4 is a perspective view of a detector from FIG. 3.
Figure 3:
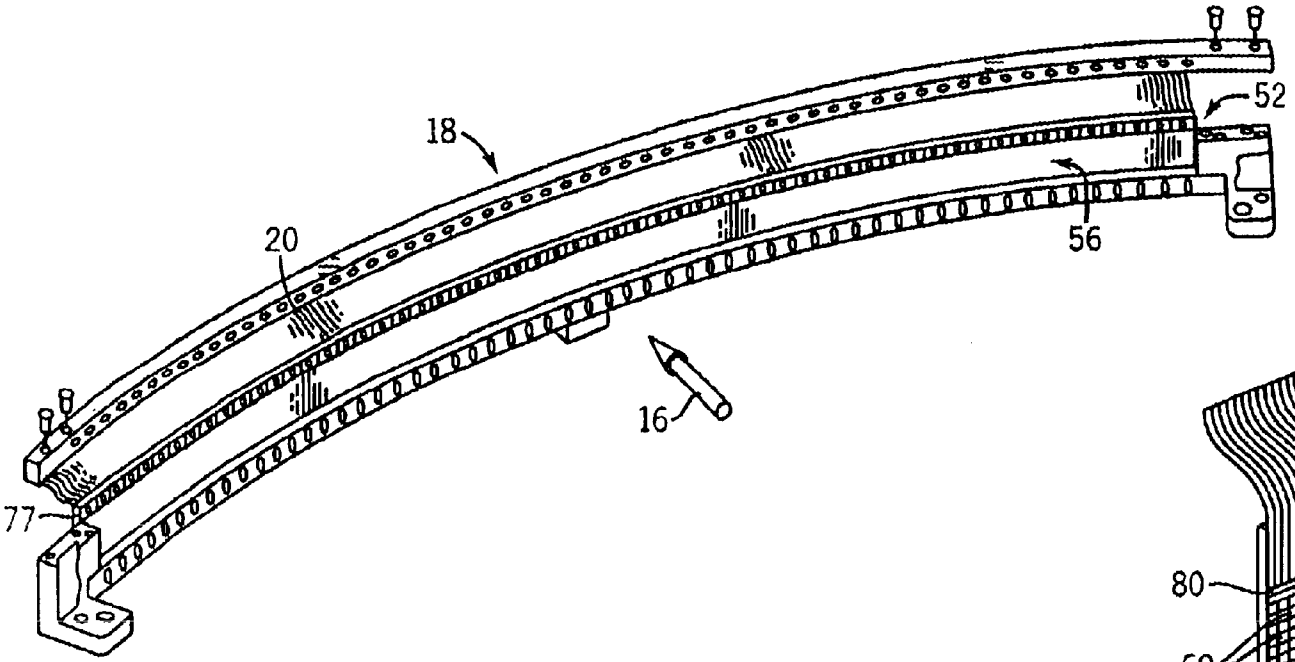
FIG. 3 is a perspective view of a CT system detector array.

As shown in FIGS. 3 and 4, detector array 18 includes a plurality of detectors 20. Each detector 20 includes a two-dimensional photodiode array 52 and a two-dimensional scintillator array 56 positioned above the photodiode array 52. A collimator (not shown) is positioned above the scintillator array 56 to collimate x-ray beams 16 before such beams impinge upon scintillator array 56. Photodiode array 52 includes a plurality of photodiodes 60, deposited or formed on a silicon chip. Scintillator array 56, as known in the art, is positioned over the photodiode array 52. Photodiodes 60 are optically coupled to scintillator array 56 and are capable of transmitting signals representative of the light output of the scintillator array 56. Each photodiode 60 produces a separate low level analog output signal that is a measurement of the attenuated beam entering a corresponding scintillator 57 of scintillator array 56. Photodiode output lines 76 may, for example, be physically located on one side of detector 20 or on a plurality of sides of detector 20. As shown in FIG. 45, photodiode output lines 76 are located on opposing sides of the photodiode array 52.

In one embodiment, as shown in FIG. 3, detector array 18 includes detectors 20. Each detector 20 includes a photodiode array 52 and scintillator array 56, each having an array size of 16×16. As a result, arrays 52 and 56 have 16 rows and 912 columns (16×57) detectors each, which allows 16 simultaneous slices of data to be collected with each rotation of gantry 12. The scintillator array 56 is coupled to the photodiode array 52 by a thin film of transparent adhesive (not shown).

Switch arrays 80 and 82, FIG. 4 are multi-dimensional semiconductor arrays having similar width as photodiode array 52. In one preferred embodiment, the switch arrays 80 and 82 each include a plurality of field effect transistors (FET). Each FET is electrically connected to a corresponding photodiode 60. The FET array has a number of output leads electrically connected to DAS 32 for transmitting signals via a flexible electrical interface 84. Particularly, about one-half of the photodiode outputs are electrically transmitted to switch array 80 and the other one-half of the photodiode outputs are electrically transmitted to switch array 82. Each detector 20 is secured to a detector frame 77, FIG. 3, by mounting brackets 79.

Switch arrays 80 and 82 further include a decoder (not shown) that controls, enables, disables, or combines photodiode output in accordance with a desired number of slices and slice resolutions. In one embodiment defined as a 16-slice mode, decoder instructs switch arrays 80 and 82 so that all rows of the photodiode array 52 are activated, resulting in 16 simultaneous slices of data available for processing by DAS 32. Of course, many other slice combinations are possible. For example, decoder may also enable other slice modes, including one, two, and four-slice modes.

Figure 5:
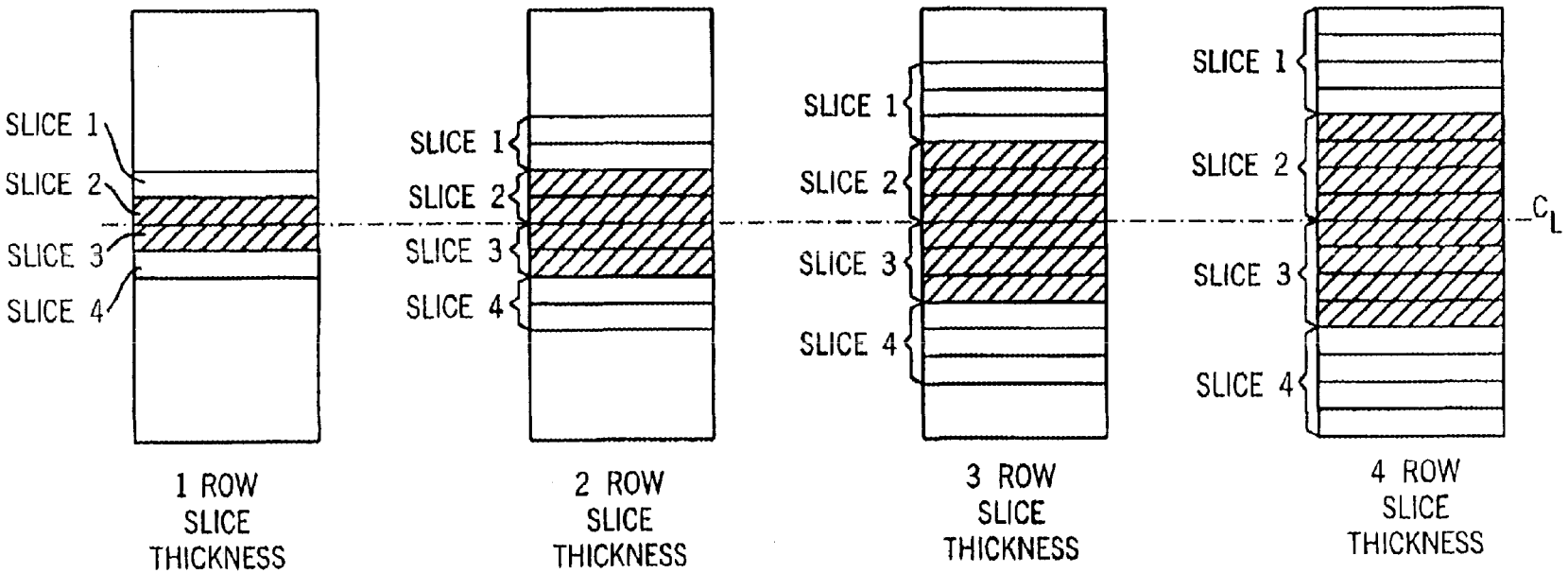
FIG. 5 is illustrative of various configurations of the detector of FIG. 4 in a four-slice mode.

Shown in FIG. 5, by transmitting the appropriate decoder instructions, switch arrays 80 and 82 can be configured in the four-slice mode so that the data is collected from four slices of one or more rows of photodiode array 52. Depending upon the specific configuration of switch arrays 80 and 82 as defined by the decoder, various combinations of photodiodes 60 of the photodiode array 52 can be enabled, disabled, or combined so that the slice thickness may consist of one, two, three, or four rows of photodiode array elements 60. Additional examples include a single slice mode including one slice with slices ranging from 1.25 mm thick to 20 mm thick, and a two slice mode including two slices with slices ranging from 1.25 mm thick to 10 mm thick. Additional modes beyond those described are contemplated.

Figure 6:
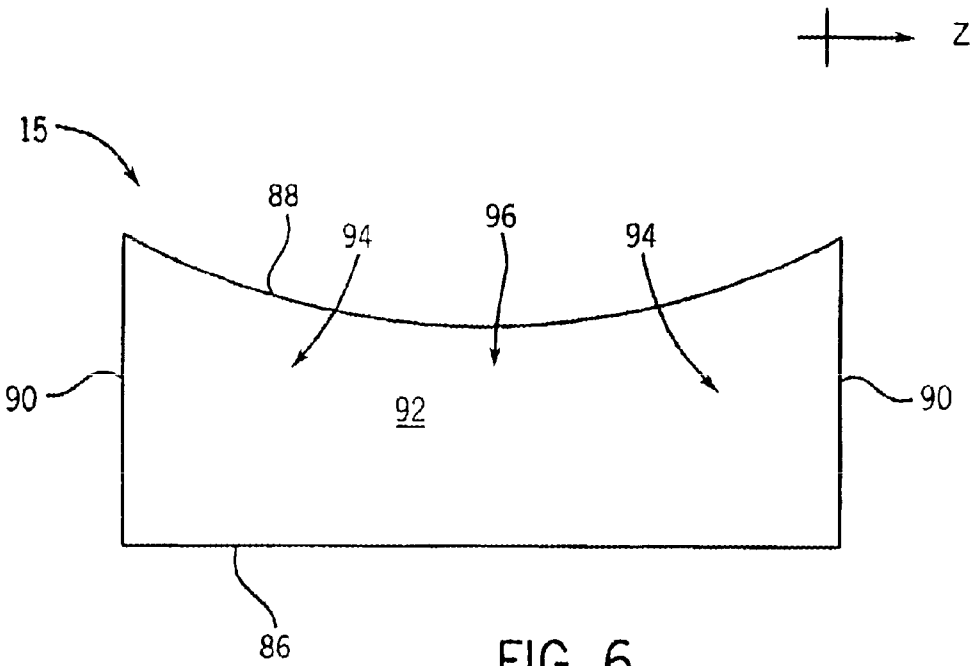
FIG. 6 is a cross-sectional view of a pre-subject filter in accordance with one embodiment of the present invention.

Now referring to FIG. 6, a cross-sectional view of the cone angle dependent pre-subject filter 15 is shown. Filter 15 includes a bottom surface 86 and a concave top surface 88. Sidewalls 90 connect the bottom surface and the convex top surface in a single solid structure. Filter 15 is formed from a filtering material 92 that, in one embodiment, has a constant density. Convex Concave top surface 88 is fabricated to have a continuous and smooth face.

Preferably, filter 15 is fabricated to have a thickness at a generally end region 94 that exceeds a thickness at a generally center region 96. That is, a maximum thickness is enjoyed at each end of the filter whereas a minimum thickness exists in the center region. As a result, the noise index at each generally end region 94 exceeds the noise index of the general center region 96. In one embodiment, filter 15 may comprise a number of thin slabs of filtering material that are stacked together such that the thickness of the filter at the end regions 94 exceeds the thickness of the center region 96 and vice-versa. Alternately, filter 15 could be equivalently formed from a bulk material having non-uniform density such that the filter has a uniform shape yet non-uniform attenuation. For example, the density of the material forming the end regions may be less than the density of the material forming the center region resulting in a varying attenuation profile of the filter. Moreover, the filter may be fabricated from more than one material with varying degrees of density.

In the reconstruction process of multi-slice CT, the measured projection data is first weighted by a set of weighting functions prior to the filtered back-projection. These weighting functions serve the purpose of interpolation to estimate a set of projections at the plane of reconstruction (POR). For multi-slice CT, one of the major sources of image artifacts is the cone beam effect. It should be noted that the projection data collected by the detector row closer to the center of the detector are nearly parallel to the POR and are essentially fan-beam sampling. For the projection data collected by the detector rows further away from the detector center, the samples are significantly non-coplanar with the POR. With two-dimensional back-projection hardware, the discrepancy between the actual x-ray path and the x-ray path assumed by the back-projection process often causes imaging artifacts. This type of artifact is commonly referred to as "cone beam artifact" referring to the cone beam nature of the data collection.

Helical weighting functions have been implemented such that projection samples with larger cone angles contribute less to the final reconstructed image. This is accomplished by assigning less weight to the data projection samples collected by the outer detector rows. For example, one of the weighting schemes for an eight slice 5:1 pitch helical reconstructions assigns the following relative weights to the eight detector rows: 0.125, 0.25, 0.375, 0.5, 0.5, 0.375, 0.25, 0.125. Different weights could be assigned however depending upon the reconstruction algorithm. It should be noted that the contribution from the outermost rows is only one-fourth of the contribution from the center rows. Because the final reconstructed image is obtained by the summation (back-projection) of signals from all detector rows, variance in the final image is the weighted sum of the variances of the projection samples of all detector rows. Since human anatomies do not change quickly over a short distance along the patient long axis, noise in the samples of all detector rows can be assumed approximately equal. Because the contribution from the outer detector rows is much less than the contribution from the inner detector rows, the efficiency of the sample utilization is not optimized. However, if the noise in the outer detector rows is increased, the impact of the noise on the final reconstructed image is much smaller than if the noise in the inner detector rows is increased. As a result, the x-ray flux to the inner detector rows may be increased and the x-ray flux to the outer detector rows may be reduced to obtain an overall improvement in terms of noise and dosage to the patient. Utilization of a cone angle dependent pre-subject filter similar to that shown in FIG. 6 increases the x-ray flux to the inner detector rows and reduces the x-ray flux to the outer detector rows yielding a reconstructed image with fewer artifacts as well as reduced x-ray to the patient.

Figure 7:
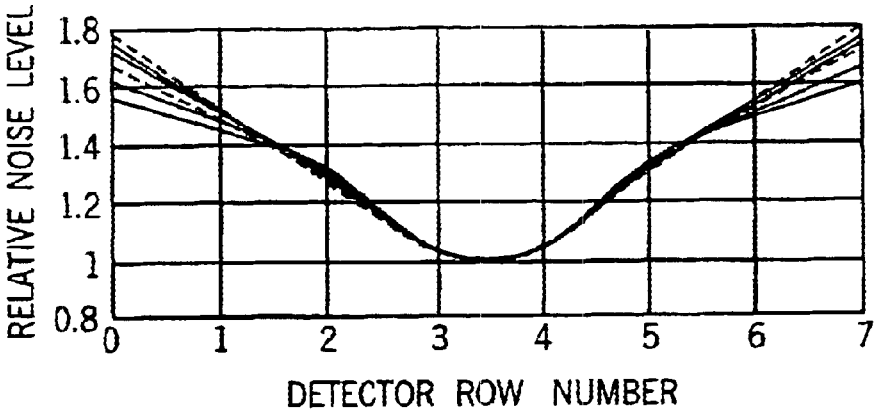
FIG. 7 is a plot of noise distribution corresponding to filters of varying designs.

Referring now to FIG. 7, noise distributions from several filter-shaped designs are shown with respect to detector row number for an eight slice helical scan. The noise level at the innermost detector rows (rows 3 and 4) is assumed to be uniform and the noise levels for the other detector rows are normalized accordingly. To ensure artifact-free image when the x-ray focal spot moves (due to mechanical or thermal expansion), the filter shape should be continuous and smooth along the z axis. The several filter-shaped designs differ from one another in the thickness of the generally end regions. As shown, the noise index increases as the thickness of each end region increases.

Figure 8:
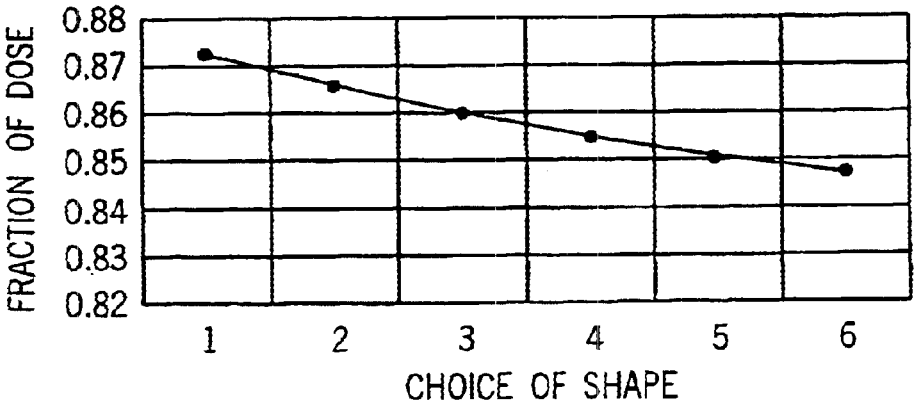
FIG. 8 is a plot of a predicted dosage based on the varying designs referenced in FIG. 7.

Referring now to FIG. 8, the relative x-ray dosage to patient for the several filter designs characteristically depicted in FIG. 7 are shown. Specifically, the fraction of total dosage projected to the patient decreases as the thickness of the filter is increased. For example, filter shape 1 provides a relative dose of 0.87 whereas filter shape 6 provides a relative dose of approximately 0.85. That is, the radiation detected by the outer rows of detector array 18, FIG. 3, decreases as thickness of the filter end regions increase.

The present invention may be incorporated into a CT medical imaging device similar to that shown in FIG. 1. Alternatively, however, the present invention may also be incorporated into a non-invasive package or baggage inspection system, such as those used by postal inspection and airport security systems.

Figure 9:
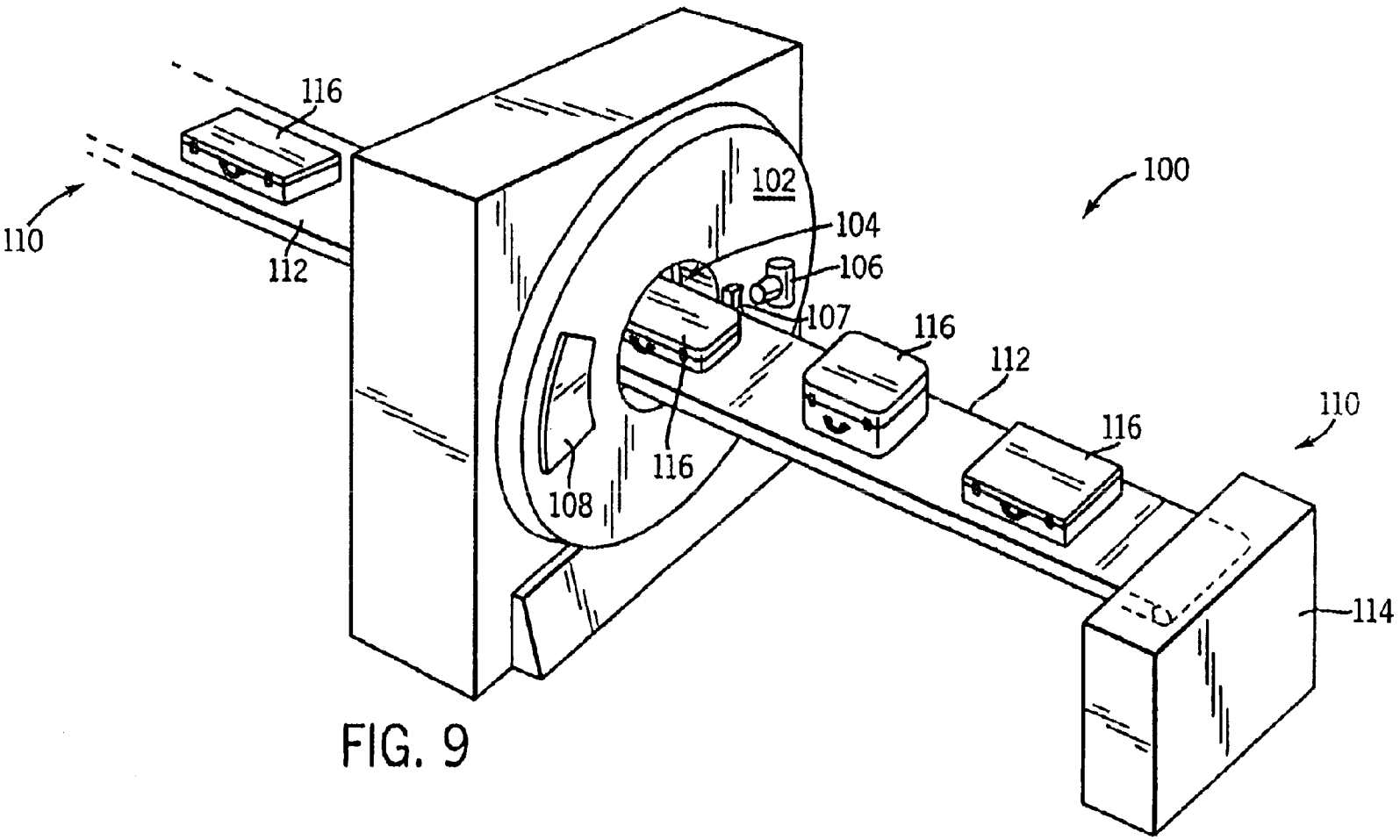
FIG. 9 is a pictorial view of one embodiment of a non-invasive baggage/package imaging system incorporating the present invention.

Referring now to FIG. 9, package/baggage inspection system 100 includes a rotatable gantry 102 having an opening 104 therein through which packages or pieces of baggage may pass. The rotatable gantry 102 houses a high frequency electromagnetic energy source 106 as well as a detector assembly 108. A filter 107 similar to that cross-sectionally shown in FIG. 6 is also housed within gantry 102. A conveyor system 110 is also provided and includes a conveyor belt 112 supported by structure 114 to automatically and continuously pass packages or baggage pieces 116 through opening 104 to be scanned. Objects 116 are fed through opening 104 by conveyor belt 112, imaging data is then acquired, and the conveyor belt 112 removes the packages 116 from opening 104 in a controlled and continuous manner. As a result, postal inspectors, baggage handlers, and other security personnel may non-invasively inspect the contents of packages 116 for explosives, knives, guns, contraband, etc.

Therefore, in accordance with one embodiment of the present invention, a cone angle dependent pre-subject filter for use with a radiation emitting imaging device is provided. The filter includes a flat surface as well as a convex concave surface. A number of sidewalls connecting the flat surface and the concave surface in a single solid structure are also provided.

In accordance with another embodiment of the present invention, a radiation emitting imaging device includes a rotatable gantry having an opening defined therein for receiving a subject to be scanned. The device further includes a subject positioner configured to position the subject within the opening as well as a high frequency electromagnetic energy projection source configured to project high frequency electromagnetic energy to the subject. The imaging device further includes at least one filtering device configured to filter high frequency electromagnetic energy projected to the subject. The filtering device is formed of a bulk of filtering material having a non-uniform attenuation. The imaging device also includes a detector array having a plurality of detectors to detect high frequency electromagnetic energy passing through the subject and to output a plurality of electrical signals indicative of an intensity of the high electromagnetic energy detected. A data acquisition system is provided and connected to the detector array and configured to receive a plurality of electrical signals. An image reconstructor connected to the data acquisition system is provided and configured to reconstruct an image of the subject from the plurality of signals received by the data acquisition system.

In accordance with a further embodiment of the present invention, a cone angle dependent pre-subject filter includes means for receiving high frequency electromagnetic energy. The filter further includes means for increasing attenuation of high frequency electromagnetic energy flux in a first region as well as means for decreasing attenuation of high frequency electromagnetic energy flux in a second region.

In accordance with yet another embodiment of the present invention, a method of manufacturing a pre-subject filter for use with a radiation emitting imaging device includes the step of defining a block of filtering material. The method further includes shaping the block to have a linear surface and fashioning a block to have a curvilinear surface.

The present invention has been described in terms of the preferred embodiment, and it is recognized that equivalents, alternatives, and modifications, aside from those expressly stated, are possible and within the scope of the appending claims.

What is claimed is:

1. A cone angle dependent pre-subject filter configuration for use with a radiation emitting imaging device, the filter configuration comprising:

a flat surface configured to extend along a z-direction;

a concave surface configured to extend parallel to the flat surface along the z-direction and arranged to optimize data utilization efficiency of the radiation emitting device; and a number of sidewalls oriented along an x-direction and connecting the flat surface and the concave surface in a single structure.

2. The filter of claim 1 formed of a filtering material having a constant density.

3. The filter of claim 1 wherein the convex surface is continuous and smooth.

4. The filter of claim 1 wherein the radiation emitting device emits x-ray radiation and the single structure is solid and has a varying thickness, wherein the thickness at a generally end region of the single solid structure exceeds a thickness at a generally center region of the single solid structure to provide an effective increase in x-ray flux to inner detector rows and reduce x-ray flux to outer detector rows and reduce overall x-ray dosage.

5. The filter of claim 4 having a noise index at the generally end region exceeding a noise index of the generally center region.

6. The filter of claim 4 incorporated into a computed tomography (CT) apparatus.

7. A radiation emitting imaging device comprising:

a rotatable gantry having an opening defined therein for receiving a subject to be scanned;

a subject positioner configured to position the subject within the opening along a z-axis;

a high frequency (HF) electromagnetic energy projection source configured to project HF electromagnetic energy to the subject;

at least one filtering device configured to filter HF electromagnetic energy projected to the subject, the filtering device having a body defined by a length that extends along the z-axis and a width that extends along an x-axis and when the body has a section of concavity that extends along the length of the filtering device;

a detector array having a plurality of detectors to detect HF electromagnetic energy passing through the subject and to output a plurality of electrical signals indicative of an intensity of the HF electromagnetic energy detected;

a data acquisition system (DAS) connected to the detector array and configured to receive the plurality of electrical signals; and an image reconstructor connected to the DAS and configured to reconstruct an image of the subject from the plurality of signals received by the DAS according to a reconstruction algorithm.

8. The radiation emitting imaging device of claim 7 wherein the at least one filtering device includes at least one of a bowtie filter and a flat filter.

9. The radiation emitting imaging device of claim 7 wherein the at least one filtering device has a cross-section defined by a first region, a second region, and a center region disposed between the first region and the second region, and wherein a thickness of the first region exceeds a thickness of the center region.

10. The radiation emitting imaging device of claim 9 wherein the thickness of the first region equals a thickness of the second region.

11. The radiation emitting imaging device of claim 10 wherein the first region and the second region each have a noise index exceeding a noise index of the center region.

12. The radiation emitting imaging device of claim 7 incorporated into at least one of a body imaging apparatus and a non-invasive package/baggage inspection apparatus.

13. The radiation emitting imaging device of claim 12 wherein the subject positioner includes one of a movable table and a conveyor.

14. The radiation emitting imaging device of claim 7 incorporated into a multi-slice helical imaging apparatus.

15. The radiation emitting imaging device of claim 7 wherein the at least one filtering device includes non-uniform x-ray reception surface.

16. The radiation emitting imaging device of claim 7 wherein the at least one filtering device is configured to reduce HF electromagnetic energy received by the subject.

17. A cone angle dependent pre-subject filter comprising:

means for increasing HF electromagnetic energy flux in a first region corresponding to a first set of rows of a CT detector array;

means for decreasing HF electromagnetic energy flux in a second region corresponding to a second set of rows of the CT detector array.

18. The filter of claim 17 further comprising means for reducing HF electromagnetic energy dosage to at least one region of the subject.

19. A method of manufacturing a pre-subject filter for use with a radiation emitting imaging device, the method comprising the steps of:

determining a desired noise index level and selecting a filtering material from a bulk having a requisite attenuation coefficient to achieve the desired noise index level;

defining a block of filtering material;

shaping the block to have a linear emission surface; and fashioning the block to have a curvilinear reception surface.

20. The method of claim 19 wherein the block includes a general first region, a general second region, and a general center region disposed therebetween and further comprising the steps of defining the first general region and the second general region to each have a thickness exceeding a thickness of the general center region.

21. The method of claim 19 wherein the general center region corresponds to a number of detector rows in a center region of a detector assembly and wherein the general first and the general second regions correspond to a number of detector rows in a first outer region and a second outer region of the detector assembly.

22. The method of claim 19 further comprising the steps of constructing the block to have a variable thickness.

23. The method of claim 19 further comprising the steps of determining a desired photon emission intensity and constructing the block to emit the desired photon emission intensity.

* * * * *